United States Patent [19]

Lindquist

[11] Patent Number: 4,619,204

[45] Date of Patent: Oct. 28, 1986

[54] DRIVERLESS TUGGER VEHICLE AND SYSTEM

[75] Inventor: Per E. Lindquist, Easton, Pa.

[73] Assignee: SI Handling Systems, Inc., Easton, Pa.

[21] Appl. No.: 559,124

[22] Filed: Dec. 7, 1983

[51] Int. Cl.[4] ..... B61B 13/12

[52] U.S. Cl. ..... 104/166; 104/162; 198/738

[58] Field of Search ..... 104/166, 162, 176, 165, 104/169; 198/747, 738; 74/89

[56] References Cited

U.S. PATENT DOCUMENTS

| | | | |
|---|---|---|---|
| 402,933 | 5/1889 | Judson | 104/166 |
| 3,861,322 | 1/1975 | Danly | 104/166 |
| 4,018,328 | 4/1977 | Galarowic et al. | 198/747 X |
| 4,252,064 | 2/1981 | Ratcliff, Jr. et al. | 104/162 |
| 4,378,741 | 4/1983 | Nagahori | 104/166 X |

*Primary Examiner*—Randolph A. Reese
*Assistant Examiner*—Glenn B. Foster
*Attorney, Agent, or Firm*—Seidel, Gonda, Goldhammer & Abbott

[57] ABSTRACT

A driverless tugger vehicle is adapted to shuttle back and forth and push or pull another driverless vehicle each time it moves in a forward direction. The tugger vehicle is propelled by frictional contact between a drive wheel and a drive shaft with the drive wheel being mounted for pivotable movement through an arc of approximately 90 degrees so that the vehicle may reciprocate in opposite directions without changing the direction of rotation of the drive shaft.

10 Claims, 7 Drawing Figures

DRIVERLESS TUGGER VEHICLE AND SYSTEM

BACKGROUND OF THE INVENTION

In various manufacturing processes, a driverless vehicle passes through a non-powered zone. The present invention is directed to the solution of the problem of how to sequentially move the driverless vehicle through said zone.

SUMMARY OF THE INVENTION

The present invention is directed to a driverless tugger vehicle adapted to shuttle back and forth on a first pair of tracks and push or pull another driverless vehicle each time the tugger vehicle moves in a forward direction. The tugger vehicle has at least one drive wheel adapted to be in frictional contact with a drive shaft. An actuator is connected to the drive wheel in a manner so that the drive wheel can pivot through an arc sufficient to cause the vehicle to be driven in opposite directions by the drive shaft. A means is provided on the vehicle and adapted for selective engagement with another vehicle to be pushed or pulled on a second path when the tugger vehicle moves in its forward direction.

It is an object of the present invention to provide a novel driverless tugger vehicle and system incorporating the same for pushing or pulling other driverless vehicles along a non-powered zone.

Various objects and advantages will appear hereinafter.

For the purpose of illustrating the invention, there is shown in the drawings, a form which is presently preferred; it being understood, however, that this invention is not limited to the precise arrangements and instrumentalities shown.

DETAILED DESCRIPTION

Figure 1:
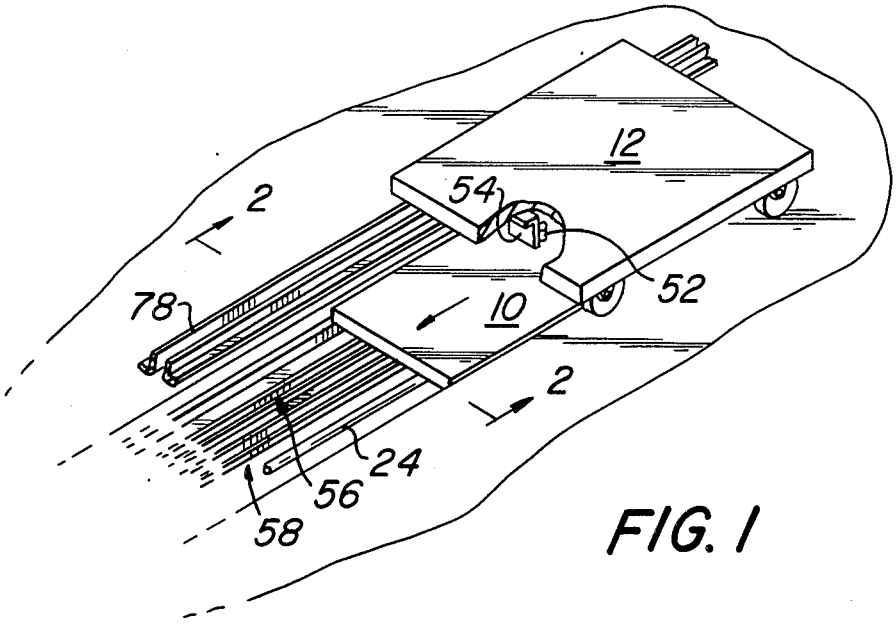
FIG. 1 is a partial perspective view of a vehicle in accordance with the present invention and pushing another driverless vehicle.

Referring to the drawing in detail, wherein like numerals indicate like elements, there is shown in FIG. 1 a tugger vehicle designated generally as 10 and adapted to push another driverless vehicle 12 along a guide path corresponding to a non-powered zone for the vehicle 12. Vehicle 10 may push or pull the vehicle 12.

The tugger vehicle 10 is a driverless vehicle having support wheels 16 and 18 riding on rails 14 and 20 respectively. The support wheels 16 and 18 depend from a horizontally disposed frame or platform 22. A drive shaft 24 is disposed between the rails 14 and 20. A motor

26 is coupled to the drive shaft 24 for rotating the drive shaft about its longitudinal axis in a single direction. The single direction is clockwise in FIG. 2. Hence, motor 26 need not be a reversible motor. Drive shaft 24 may be a plurality of shafts of finite length connected end to end.

One or more drive wheels are supported by the platform 22. As illustrated in the drawings, the platform 22 supports a pair of drive wheels 28 and 30. The number of drive wheels utilized is a function of the power needed to enable vehicle 10 to propel vehicle 12. Each drive wheel is supported in a conventional manner by a mounting so that the drive wheels rotate about a horizontal axis while the mounting may oscilate about a vertical axis. The mountings for the drive wheels 28 and 30 are coupled together by a connecting rod 32. The mounting for drive wheel 30 is pivotably connected to one end of a rod 33. The other end of rod 33 is pivotably connected to leg 35 of a bell crank 34 at pivot 36.

Figure 2:
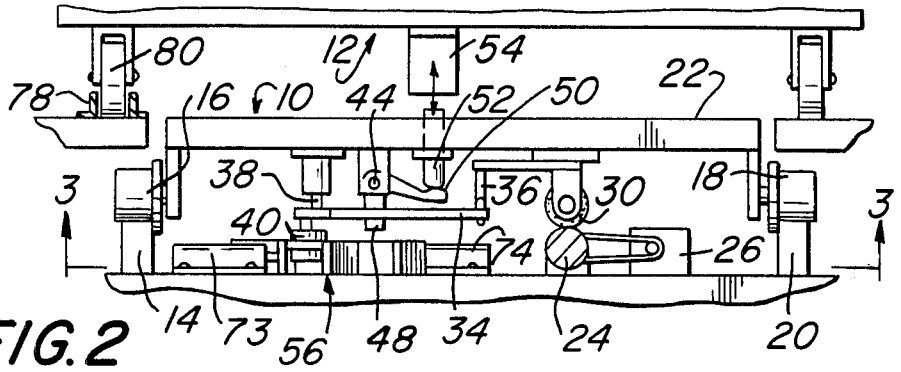
FIG. 2 is a sectional view taken along the line 2—2 in FIG. 1.

The bell crank 34 pivots about pivot 38. As shown in FIG. 2, the pivots 36 and 38 are vertically disposed. The other leg of bell crank 34 is designated 37. A rotatable cam follower 40 depends from a free end portion of the leg 37 on the bell crank 34.

Figure 7:
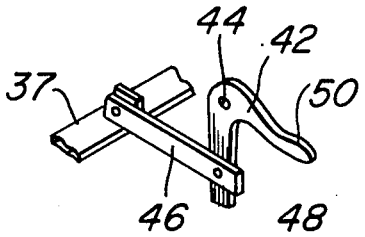
FIG. 7 is a perspective view of the coupling between two bell cranks on the tugger vehicle.

A bell crank 42 is pivotably secured to the bottom of the vehicle 10 and pivots about the horizontally disposed axis 44. See FIGS. 2 and 7. Leg 48 of bell crank 42 is pivotably connected to one end of a link 46. The other end of link 46 is pivotably connected to the leg 37 on the bell crank 34. The other leg 50 of the bell crank 42 is adapted to move a latch pin 52 vertically to a position wherein it may contact the abutment 54 on the vehicle 12. Contact between latch pin 52 and abutment 54 enables the tugger vehicle 10 to pull the vehicle 12 as the vehicle 10 moves in a forward direction from right to left as shown in FIG. 1.

Between the rails 14 and 20, there is provided a set of guides 56 and a set of guides 58. The length of the guides 56, 58 defines the length of the reciprocatory movement for the tugger vehicle 10. The guides 56 and 58 are substantially identical but of opposite hand. Guides 56 are provided with cam portions 60 at one end and cam portions 62 at their other end. Guides 58 are provided with cam portions 64 at one end and cam portions 66 at the other end. Cam portions 60, 66 are matching portions but at opposite ends of the guides. Likewise, portions 62 and 64 are matching portions at opposite ends of the guides. Limit stops 70 are provided at opposite ends of the travel for the tugger vehicle 10. Only one limit stop 70 is shown. See FIG. 3. Limit stop 70 is preferaably adjustable in any conventional manner so that vehicle 10 will come to rest while having a small rearward thrust at one end of its travel and a small forward thrust at the other end of its travel.

Figure 3:
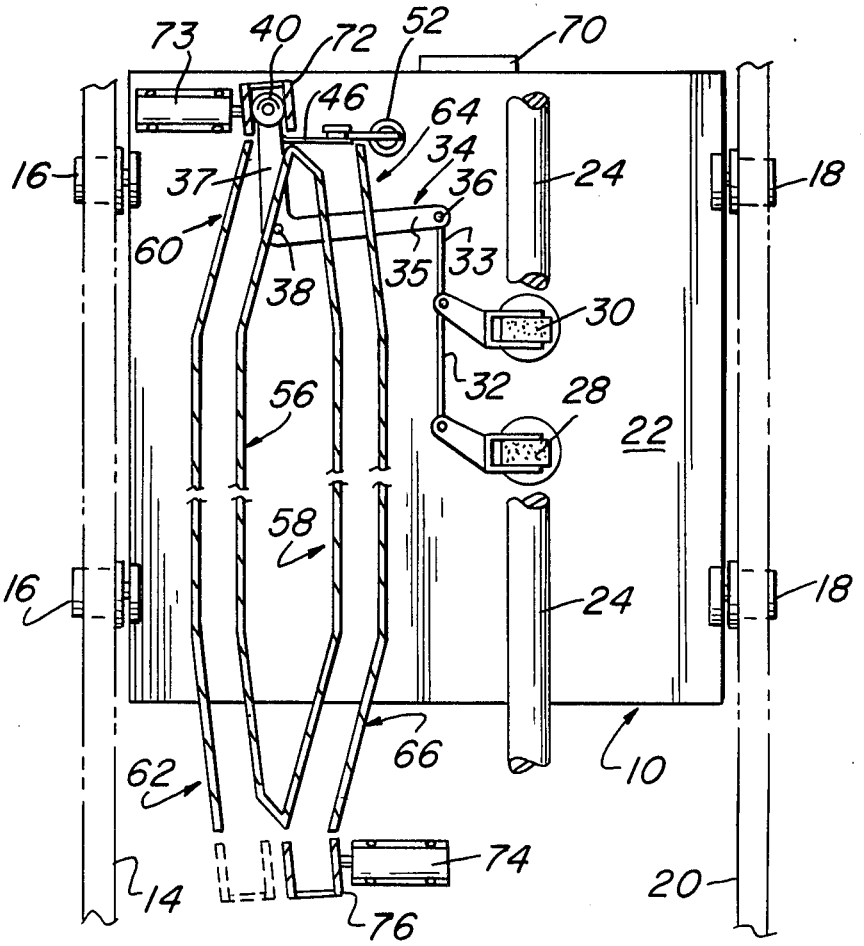
FIG. 3 is a view taken along the line 3—3 in FIG. 2 as shown in the tugger vehicle in a stationary position.

As shown more clearly in FIG. 3, when the tugger vehicle 10 arrives at limit stop 70, the cam follower 40 will exit from the cam portion 60 and enter a transfer device 72 with the bell crank 34 at an angle whereby a small thrust of about five degrees will be provided for the drive wheels 28 and 30. Such thrust maintains the tugger vehicle 10 against the limit stop 70. Adjustability of the limit stop 70 assures that such small thrust can be maintained. Transfer device 72 is connected to one end of a piston rod associated with cylinder 73. When the tugger vehicle 10 is in contact with the limit stop 70, it will trip a microswitch (not shown) to actuate cylinder 73.

Figure 4:
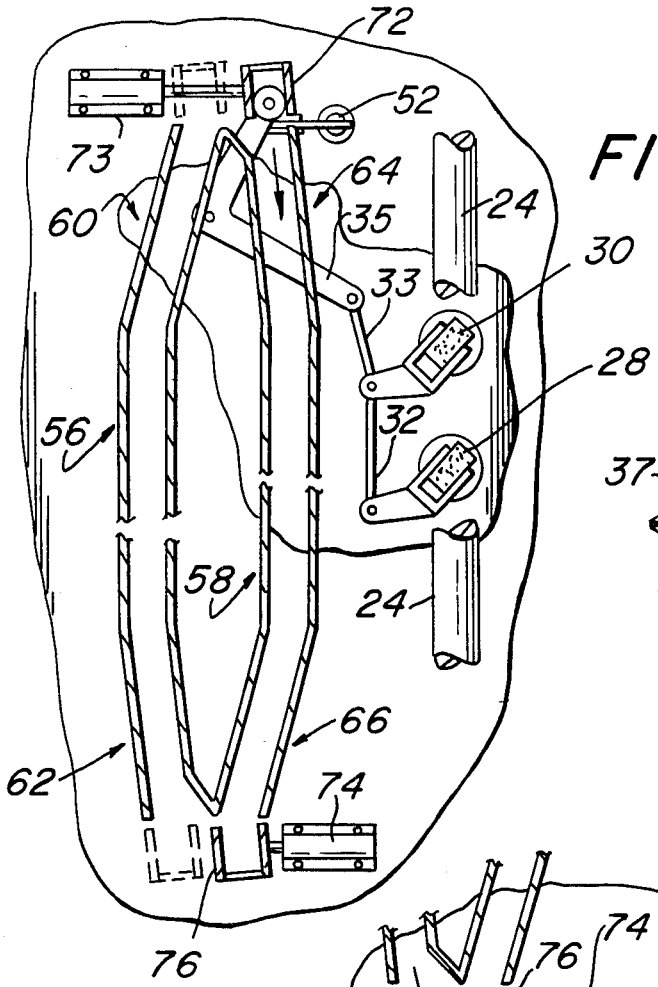
FIG. 4 is a diagrammatic view similar to FIG. 3 but showing the drive wheels of the tugger vehicle moved to a position so that the tugger vehicle can move in a rearward direction.

When cylinder 73 is actuated, it will shift the device 72 from the position shown in FIG. 3 to the position shown in FIG. 4. Such shifting movement will pivot the bell crank 34 from the position shown in FIG. 3 to the position shown in FIG. 4. As a result thereof, latch pin 52 will move upwardly so that it may engage the abutment 54 on vehicle 12. At the same time, the drive wheels 28 and 30 will have been shifted through an angle whereby they are now positioned to cause the tugger vehicle 10 to move in a forward direction away from limit stop 70. As the tugger vehicle moves forwardly, the cam follower 40 is now guided by cam portion 64 which causes the vehicle to increase speed. The tugger vehicle 12 reaches maximum speed as it is moving along the straight portions of the guides 56, 58. See FIG. 4.

Figure 6:
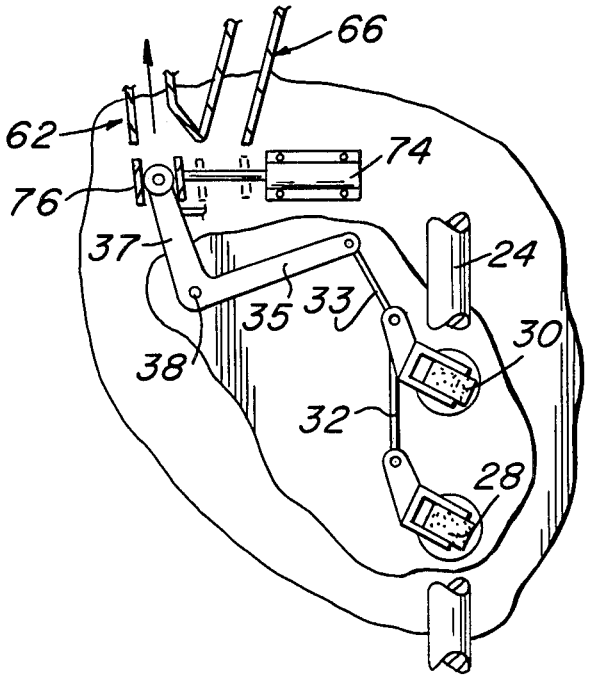
FIG. 6 is a view similar to FIG. 5 but showing the drive wheels on the tugger vehicle manipulated to a position so that the tugger vehicle may move forwardly.
Figure 5:
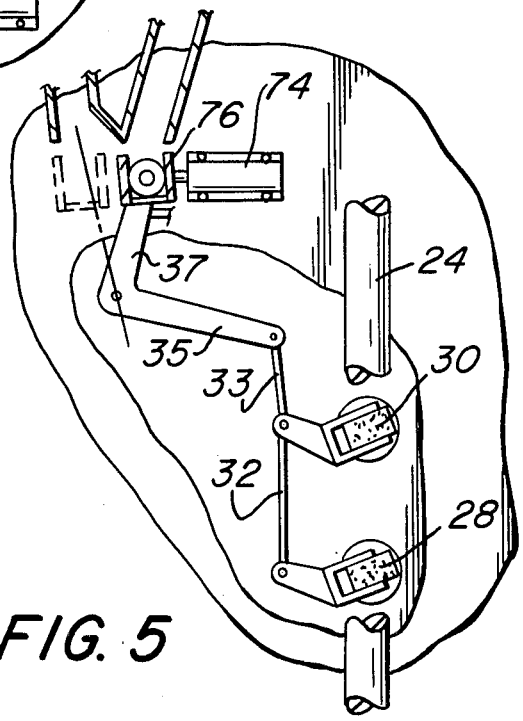
FIG. 5 is a view similar to FIG. 2 but showing the tugger vehicle and its drive wheels at the rear most end of its path.

When the tugger vehicle 10 reaches the end of its forward movement, it contacts a limit stop (not shown) with the drive wheels 28, 30 being biased to a small angle such as five degrees. See FIG. 5. A switch is tripped by the vehicle 10 to actuate cylinder 74. A transfer device 76 is connected to the cylinder 74. Device 76 is shifted from the position shown in FIGS. 4 and 5 to the position shown in FIG. 6. At the same time, the pivotable movement of the bell crank 34 moves the bell crank 42 which enables the latch pin 52 to descend to an inoperative position. The bell crank 34 moves the drive wheels 28 and 30 from the position shown in FIG. 5 to the position shown in FIG. 6. The tugger vehicle is now in a position to move rearwardly. Cam follower 40 enters the cam portion 62 and traverses the length of guide 56 back to the starting position.

The tugger vehicle 10 shuttles back and forth along a path defined by the rails 14 and 20. At one end of its travel the tugger vehicle will be coupled to a driverless vehicle 12 and push or pull the vehicle 12. At the other end of its travel, the tugger vehicle will become disconnected from the vehicle 12. Drive shaft 24 continuously rotates in one direction. The drive wheels 28 and 30 are oscillated through a total arc of about 90° with the angle of the drive wheels being approximately plus 45° when moving in one direction and minus 45° when moving in an opposite direction. Compare FIGS. 4 and 6.

The driverless vehicle 12 supports a load (not shown) to be worked on as it traverses the non-powered zone defined by the path of movement of the tugger vehicle 10. Such non-powered zone for the vehicle 12 may be a paint spray booth. The vehicle 12 is provided with a separate guide path such as guide rails 78 which cooperate with the wheels 80 on the vehicle 12. Guide rails 78 may cooperate with all of the wheel 80 or only the wheels 80 on one side of the vehicle 12. Also, guide rails may be above rails 14, 20 or alongside rails 14, 20.

The bell crank 42 is one type of mechanism which may be utilized for latching and unlatching the vehicles 10 and 12 in response to pivotable movement of the bell crank 34. Other types of mechanisms may be substituted for bell crank 42 so as to provide a pushing or pulling coupling between the vehicles 10 and 12 as vehicle 10 moves forwardly and to facilitate disengagement of the vehicles at the end of a forward movement of the tugger vehicle 12. At the end of a forward movement of the tugger vehicle 12, the guide path for the vehicle 12 may be sloped downwardly so as to utilize gravity and enable the vehicle 12 to move forwardly for a sufficient distance without power until it contacts its powered conveyor while tugger vehicle 12 returns to its start position to propel another driverless vehicle as described above.

The present invention may be embodied in other specific forms without departing from the spirit or essential attributes thereof and, accordingly, reference should be made to the appended claims, rather than to the foregoing specification, as indicating the scope of the invention.

It is claimed:

1. A driverless tugger vehicle adapted to shuttle back and forth on a first path to push or pull another driverless vehicle each time it moves in a forward direction, said tugger vehicle including a platform having support wheels, at least one drive wheel on said tugger vehicle, said drive wheel being adapted to be in frictional contact with a drive shaft separate from the tugger vehicle and positioned to be adjacent to said first path for propelling the tugger vehicle, an actuator connected to said drive wheel in a manner so that the drive wheels can pivot through an arc sufficient to cause the vehicle to be driven in opposite directions by a drive shaft, and means coupled to said actuator on said tugger vehicle adapted for selective engagement with another vehicle when the tugger vehicle moves in the forward direction to push or pull a second vehicle along a second path parallel to said first path only when the tugger vehicle moves in the forward direction.

2. A vehicle in accordance with claim 1 wherein said actuator includes a bell crank having one end coupled to said drive wheel and having a cam follower at its other end.

3. A vehicle in accordance with claim 2 wherein said cam follower is at an elevation below the elevation of said support wheels, and said arc being approximately 90°.

4. A driverless vehicle system comprising a driverless tugger vehicle adapted to shuttle back and forth along a first path and push or pull another driverless vehicle each time it moves in a forward direction, a pair, of rails defining said first path, support wheels on said tugger vehicle and in rolling contact with said rails, a drive shaft separate from said tugger vehicle and parallel to said rails and rotatable about its longitudinal axis, at least one drive wheel on said tugger vehicle, said drive wheel being in frictional contact with said drive shaft, an actuator connected to said drive wheel for pivoting the drive wheel through an arc sufficient so that the tugger vehicle can be driven in opposite directions by said shaft, power means for shifting said actuator adjacent opposite ends of travel of said tugger vehicle, and means coupled to said actuator on the tugger vehicle for selective engagement with another vehicle to be pushed or pulled along a second path parallel to said first path only when the tugger vehicle moves in a forward direction.

5. A system in accordance with claim 4 wherein said actuator includes a cam follower, a pair of longitudinally extending guides between said rails, the guides being closer to each other at their ends as compared with the distance between the guides in a central portion thereof, said guides being adapted to cooperate with said cam follower to pivot said drive wheel, and said power means being adapted to transfer the cam follower from one guide to another at the ends of the guides.

6. A system in accordance with claim 5 wherein said power means includes a motor and transfer device for transferring the cam follower in a direction transverse with respect to said rails.

7. A system in accordance with claim 5 wherein said guides are channels open at their upper ends.

8. A system in accordance with claim 4 wherein said second path is at an elevation which is above the elevation of the first path.

9. A system in accordance with claim 4 including a motor connected to said drive shaft for continuously rotating said drive shaft in only one direction.

10. A driverless vehicle system comprising a driverless tugger vehicle adapted to shuttle back and forth along a first path and to push or pull another driverless vehicle each time it moves in a forward direction, the system comprising: a pair of rails defining a first path, support wheel on said tugger vehicle and in rolling contact with said rails, a drive shaft separate from said tugger vehicle and parallel to said rails and rotatable about its longitudinal axis, at least one drive wheel on said tugger vehicle, said drive wheel being in frictional contact with said drive shaft, a motor for rotating said shaft, an actuator connected to said drive wheel for pivoting the drive wheel through an arc sufficient so that the tugger vehicle can be driven in opposite direction by said shaft, discrete power means for shifting said actuator adjacent to opposite ends of travel of said tugger vehicle, means coupled to said actuator on the tugger vehicle for selective engagement with another vehicle only when the tugger vehicle moves in the forward direction to push or pull a second vehicle along a second path parallel to said first path when the tugger vehicle moves in a forward direction, said actuator including a cam follower, a pair of longitudinally extending guides between said rails, the guides being closer to each other at their ends as compared with the distance between the guides in the central portion thereof, said guides being adapted to cooperate with said cam follower to pivot said drive wheel to control the speed of the tugger vehicle, a limit stop adjacent to the ends of said guides and spaced therefrom so that said follower is in a position whereby the tugger vehicle has a small thrust against said limit stop until the associated power means shifts the cam follower, and means for causing said engagement means to move in an operative or inoperative position as said power means shifts said cam follower.

* * * * *